US009127339B2

(12) United States Patent
Hoshino

(10) Patent No.: US 9,127,339 B2
(45) **Date of Patent: *Sep. 8, 2015**

(54) DUAL-PURPOSE FACILITY OF CONTINUOUS HOT-DIP COATING AND CONTINUOUS ANNEALING

(71) Applicant: NIPPON STEEL & SUMITOMO METAL CORPORATION, Tokyo (JP)

(72) Inventor: Masanori Hoshino, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/098,245

(22) Filed: Dec. 5, 2013

(65) Prior Publication Data

US 2014/0090595 A1 Apr. 3, 2014

Related U.S. Application Data

(63) Continuation of application No. 13/498,461, filed as application No. PCT/JP2010/066394 on Sep. 22, 2010, now Pat. No. 8,714,104.

(30) Foreign Application Priority Data

Oct. 1, 2009 (JP) ..... 2009-229519

(51) Int. Cl.
*B05C 3/02* (2006.01)
*B05C 3/132* (2006.01)
(Continued)

(52) U.S. Cl.
CPC . *C23C 2/003* (2013.01); *B05C 3/02* (2013.01); *B05C 3/125* (2013.01); *B05C 3/132* (2013.01); *C21D 9/56* (2013.01); *C21D 9/667* (2013.01); *F27B 9/28* (2013.01); *F27B 9/3011* (2013.01)

(58) Field of Classification Search
None
See application file for complete search history.

(56) References Cited

U.S. PATENT DOCUMENTS 4,256,519 A 3/1981 Yoshida et al.
4,408,561 A 10/1983 Yokoyama et al.
(Continued)

FOREIGN PATENT DOCUMENTS

CN 100357461 C 12/2007
JP 58-31264 U 3/1983
(Continued)

OTHER PUBLICATIONS

Chinese Office Action for corresponding Chinese Application No. 201080042967.6 dated Mar. 5, 2013 (with English translation of the Search Report).
(Continued)

*Primary Examiner* — Dah-Wei D Yuan
*Assistant Examiner* — Jethro M Pence
(74) *Attorney, Agent, or Firm* — Birch, Stewart, Kolasch & Birch, LLP

(57) ABSTRACT

A dual-purpose facility of continuous hot-dip coating and continuous annealing is configured so as to be switched between a continuous hot-dip coated material production line and a continuous annealed material production line, and includes a gas discharge path that discharges atmosphere gas in an annealing furnace from a gas discharge port provided in an outlet side of the annealing furnace out of the annealing furnace and a path opening and closing unit for opening and closing the gas discharge path. The path opening and closing unit opens the gas discharge path when the dual-purpose facility is used as the continuous hot-dip coated material production line and closes the gas discharge path when the dual-purpose facility is used as the continuous annealed material production line.

8 Claims, 8 Drawing Sheets

(51) Int. Cl.

| | |
|---|---|
| ***C23C 2/36*** | (2006.01) |
| ***C23C 2/00*** | (2006.01) |
| ***B05C 3/12*** | (2006.01) |
| ***C21D 9/56*** | (2006.01) |
| ***C21D 9/667*** | (2006.01) |
| ***F27B 9/28*** | (2006.01) |
| ***F27B 9/30*** | (2006.01) |

(56) References Cited

U.S. PATENT DOCUMENTS

| | | | | |
|---|---|---|---|---|
| 6,315,829 | B1 | 11/2001 | Ishii et al. | |
| 6,620,262 | B1 * | 9/2003 | Okita et al. | 148/226 |
| 2003/0189276 | A1 | 10/2003 | Hoshino et al. | |
| 2009/0308498 | A1 | 12/2009 | Matsumura et al. | |

FOREIGN PATENT DOCUMENTS

| | | | |
|---|---|---|---|
| JP | 5-9591 | A | 1/1993 |
| JP | 7-24968 | A | 1/1995 |
| JP | 7-24968 | U | 5/1995 |
| JP | 7-233457 | A | 9/1995 |
| JP | 8-199246 | A | 8/1996 |
| JP | 2000-265217 | A | 9/2000 |
| JP | 2002-88414 | A | 3/2002 |
| JP | 2004-346359 | A | 12/2004 |
| JP | 2007-146242 | A | 6/2007 |

OTHER PUBLICATIONS

International Search Report issued in PCT/JP2010/066394, dated Dec. 28, 2010.

U.S. Office Action, dated May 20, 2013, issued in U.S. Appl. No. 13/498,461.

U.S. Office Action, dated Sep. 26, 2013, issued in U.S. Appl. No. 13/498,461.

Written Opinion of the International Searching Authority issued in PCT/JP2010/066394, dated Dec. 28, 2010.

* cited by examiner

PRIOR ART

DUAL-PURPOSE FACILITY OF CONTINUOUS HOT-DIP COATING AND CONTINUOUS ANNEALING

This application is a Continuation application of U.S. application Ser. No. 13/498,461, filed on Mar. 27, 2012, which is the National Phase of International Application No. PCT/JP2010/066394 filed on Sep. 22, 2010, which claims priority to Japanese Patent Application No. 2009-229519 filed on Oct. 1, 2009, all of which are hereby expressly incorporated by reference into the present application.

FIELD OF THE INVENTION

The present invention relates to a dual-purpose facility of continuous hot-dip coating and continuous annealing which is configured so as to switch a continuous hot-dip coated material production line and a continuous annealed material production line.

DESCRIPTION OF RELATED ART

In conventional techniques, from the viewpoint of improving economic efficiency, a dual-purpose facility is suggested which switches a continuous hot-dip coated material production line for a coated steel sheet and a continuous annealed material production line for a cold-rolled steel sheet and can operate through a single facility. In the dual-purpose facility, when the facility is used as the continuous hot-dip coated material production line, a steel strip is immersed into a hot-dip coating bath and the hot-dip coating is performed to the steel strip. On the other hand, when the facility is used as the continuous annealed material production line, the steel strip bypasses the hot-dip coating bath and the hot-dip coating is not performed to the steel strip.

For example, in Patent Citation 1 or Patent Citation 2 described below, as shown in FIGS. 8A and 8B, a dual-purpose facility 101 is disclosed in which a steel strip carrying-out port 125 for feeding a steel strip W in ambient air outside a furnace is provided in an outlet side of an annealing furnace 103, the steel strip W is guided out of the furnace through the steel strip carrying-out port 125 when the facility is used as the continuous annealed material production line, and the steel strip bypasses a hot-dip coating bath 105. Moreover, in FIGS. 8A and 8B, a reference symbol 111 indicates a heating zone which heats the steel strip W, a reference symbol 112 indicates a soaking zone which holds the heated steel strip W in a predetermined temperature range, and reference symbols 113 and 114 each indicate a slow cooling zone and a cooling zone which cool the steel strip W.

Moreover, in Patent Citation 3, a dual-purpose facility (not shown) is disclosed in which the steel strip bypasses the hot-dip coating bath by vertically tilting a snout which guides the steel strip into the hot-dip coating bath when the facility is used as the continuous annealed material production line.

PATENT CITATION

[Patent Citation 1] Japanese Unexamined Utility Model Application, First Publication No. S58-31264

[Patent Citation 2] Japanese Unexamined Patent Application, First Publication No. 2002-88414

[Patent Citation 3] Japanese Unexamined Patent Application, First Publication No. 2000-265217

SUMMARY OF THE INVENTION

Problems to be Solved by the Invention

However, when the dual-purpose facility is used, as described below, there is a problem in that a flow direction of atmosphere gas in the annealing furnace is changed when the facility is used as the continuous hot-dip coated material production line and when the facility is used as the continuous annealed material production line.

When the facility is used as the continuous hot-dip coated material production line, in general, as shown in FIG. 8A, a lower end portion 121*b* of the snout 121 is immersed into the hot-dip coating bath 105. Moreover, the steel strip carrying-out port 125, which is used for bypassing the hot-dip coating bath 105 when the facility is used as the continuous annealed material production line, is closed. Therefore, the atmosphere gas in the annealing furnace 103 flows along a direction toward a steel strip carrying-in port 123 which is used for feeding the steel strip W in the annealing furnace 103, that is, a direction $Q_1$ from an outlet side of the annealing furnace 103 toward the inlet side.

In contrast, when the facility is used as the continuous annealed material production line, as shown in FIG. 8B, it is necessary to move the snout 121 out of the hot-dip coating bath 105 for maintenance or the like. In this case, not only the steel strip carrying-in port 123 but also the steel strip carrying-out port 125 or the lower end portion 121*b* of the snout 121 communicates with the air outside the annealing furnace 103. Thereby, the atmosphere gas in the annealing furnace 103 flows not only along the direction $Q_1$ toward the inlet side of the annealing furnace 103 but also along a direction $Q_2$ toward the outlet side.

In this way, if the flow direction of the atmosphere gas is changed, a furnace pressure balance in each zone 111, 112, 113, and 114 in the annealing furnace 103 is changed when the facility is used as the continuous hot-dip coated material production line and when the facility is used as the continuous annealed material production line. If the change in the furnace pressure balance is generated, the outside air penetrates into the annealing furnace 103 immediately after the line switching, or the like. As a result, there is a concern that the quality of the steel strip may be decreased.

Moreover, when the change in the furnace pressure balance is generated, in order to stabilize the quality of steel strip both when the facility is used as continuous hot-dip coated material production line and when the facility is used as the continuous annealed material production line, it is necessary to obtain the appropriate furnace pressure balance by adjusting the furnace pressure for each zone 111, 112, 113, and 114. In this case, a method which regulates the ratio of the supplying amount of the atmosphere gas, which is supplied to each zone 111, 112, 113, and 114 from the atmosphere gas supply source 115, for each zone 111, 112, 113, and 114 by a flow rate regulating valve 116, or a method which regulates a total supplying amount of the atmosphere gas supplied from the atmosphere gas supply source 115 is adopted. Regulating an operation condition such as the ratio for each zone 111, 112, 113, and 114 of the supplying amount of the atmosphere gas or the total supplying amount of the atmosphere gas each time the line is changed generates problems such as complication or delay of the line switching operation, adjustment error according to the complication is increased, and there is a concern that the operation itself may be unstable.

In addition, the atmosphere gas is discharged only from the inlet side of the annealing furnace 103 when the facility is used as the continuous hot-dip coated material production line while the atmosphere gas is discharged from both sides of the inlet side and the outlet side of the annealing furnace 103 when the facility is used as the continuous annealed material production line. This means that it is necessary to supply a lot of atmosphere gas in the case where the facility is used as the continuous annealed material production line compared to the case where the facility is used as the continuous hot-dip coated material production line when the pressure in the annealing furnace 103 is maintained so as to be the same pressure in the same operating time between both lines, and therefore, in the conventional technique, the atmosphere gas is excessively used by the corresponding amount.

In order to solve the problems, for example, it is considered that a sealing device shown in Patent Citation 1 is installed in the vicinity of the steel strip carrying-out port 125 of the annealing furnace 103 which communicates with the outside air when the facility is used as the continuous annealed material production line, and it is possible to suppress the atmosphere gas in the annealing furnace 103 from being discharged out of the furnace. However, even in this case, it is difficult to completely suppress the atmosphere gas from being discharged out of the furnace, and the above-described problems cannot be effectively solved.

In addition, as shown in Patent Citation 2, it is also considered that a bypass device (not shown) is provided which is capable of directly guiding the steel strip without exposing the steel strip to outside air from the steel strip carrying-out port provided in the outlet side of the annealing furnace to a water quenching device provided on the continuous annealed material production line in order to solve the above-described problems. However, in this case, there is a need to install a separate furnace shell configuring the bypass device, the entire facility becomes large-scale, and costs for manufacturing the facility increase due to the fact that the furnace shell itself is relatively expensive.

The present invention is made in consideration of the above-described problems, and an object thereof is to provide a dual-purpose facility of continuous hot-dip coating and continuous annealing. The dual purpose facility in regard to the object is capable of advantageously solving problems due to a change in the flow direction of atmosphere gas in an annealing furnace when the facility is used in both a continuous hot-dip coated material production line and a continuous annealed material production line. Here, the dual-purpose facility is configured so as to switch the continuous hot-dip coated material production line and the continuous annealed material production line, and in the dual-purpose facility, a steel strip is guided from an inner portion of a furnace into air outside the furnace when the facility is used as the continuous annealed material production line.

Methods for Solving the Problem

In order to solve the above-described problems, the inventors have conducted intensive studies, as a result, the inventors invent a dual-purpose facility of continuous hot-dip coating and continuous annealing such as the followings.

(1) A dual-purpose facility of continuous hot-dip coating and continuous annealing according to a first aspect of the present invention is configured so as to be switched between a continuous hot-dip coated material production line in which a steel strip annealed in an annealing furnace is immersed into a hot-dip coating bath and a continuous annealed material production line in which the steel strip bypasses the hot-dip coating bath and is guided out of the annealing furnace into the air outside the furnace, and includes a gas discharge path that discharges atmosphere gas in the annealing furnace from a gas discharge port provided in an outlet side of the annealing furnace out of the annealing furnace and a path opening and closing unit for opening and closing the gas discharge path. In addition, the path opening and closing unit opens the gas discharge path when the dual-purpose facility is used as the continuous hot-dip coated material production line and closes the gas discharge path when the dual-purpose facility is used as the continuous annealed material production line.

(2) In the dual-purpose facility of continuous hot-dip coating and continuous annealing according to (1), the following configuration may be provided: the dual-purpose facility further include a flow rate regulating unit that is disposed in the gas discharge path and a furnace pressure measuring unit for measuring a furnace pressure in the annealing furnace, wherein the discharge amount of the atmosphere gas, which is discharged out of the annealing furnace through the gas discharge path when the dual-purpose facility is used as the continuous hot-dip coated material production line, is regulated by the flow rate regulating unit based on the furnace pressure which is measured by the furnace pressure measuring unit when the dual-purpose facility is used as the continuous annealed material production line.

(3) The dual-purpose facility of continuous hot-dip coating and continuous annealing according to (1) may further include a gas suction unit that is disposed in the gas discharge path, for suctioning the atmosphere gas in the annealing furnace, and for discharging the gas out of the furnace.

(4) In the dual-purpose facility of continuous hot-dip coating and continuous annealing according to (3), the gas suction unit may be an ejector.

(5) In the dual-purpose facility of continuous hot-dip coating and continuous annealing according to (4), the ejector may suction the atmosphere gas in the annealing furnace based on a negative pressure which is generated by non-oxidizing gas supplied to the inner portion of the ejector.

(6) The dual-purpose facility of continuous hot-dip coating and continuous annealing according to (2) may further include a gas suction unit that is disposed in the gas discharge path, for suctioning the atmosphere gas in the annealing furnace, and for discharging the gas out of the furnace.

(7) In the dual-purpose facility of continuous hot-dip coating and continuous annealing according to (6), the gas suction unit may be an ejector.

(8) In the dual-purpose facility of continuous hot-dip coating and continuous annealing according to (7), the ejector may suction the atmosphere gas in the annealing furnace based on a negative pressure which is generated by non-oxidizing gas supplied to the inner portion of the ejector.

(9) In the dual-purpose facility of continuous hot-dip coating and continuous annealing according to (7), the ejector may be disposed to the inner portion side of the annealing furnace rather than the flow rate regulating unit in the gas discharge path.

(10) In the dual-purpose facility of continuous hot-dip coating and continuous annealing according to (8), the ejector may be disposed to the inner portion side of the annealing furnace rather than the flow rate regulating unit in the gas discharge path.

(11) The dual-purpose facility of continuous hot-dip coating and continuous annealing according to (1) may further include a cyclone that is disposed in the gas discharge path and removes metal fumes contained in the atmosphere gas by making the atmosphere gas have a rotational flow.

(12) The dual-purpose facility of continuous hot-dip coating and continuous annealing according to (11) may further include a gas suction unit that is disposed in the gas discharge path, for suctioning the atmosphere gas in the annealing furnace, and for discharging the gas out of the furnace.

(13) In the dual-purpose facility of continuous hot-dip coating and continuous annealing according to (12), the cyclone may be disposed to the inner portion side of the annealing furnace rather than the gas suction unit in the gas discharge path.

Effects of the Invention

According to the dual-purpose facility of continuous hot-dip coating and continuous annealing according to (1), the directions in which the atmosphere gas flows in the annealing furnace are adjusted so as to be the same as each other when the facility is used as both the continuous hot-dip coated material production line and continuous annealed material production line. Further, in a case where uses in both the continuous hot-dip coated material production line and the continuous annealed material production line are compared, it is possible to make the discharge amounts of the gasses which are discharged from the outlet side of the annealing furnace approach each other. Thereby, it is possible to stabilize a furnace pressure balance when both lines are used. In addition, since it is possible to make the discharge amounts of the gasses which are discharged from the outlet side of the annealing furnace approach each other when both lines are used, even in a case so as to hold to the same pressure within the annealing furnace between the applications at both lines, it is possible to make the total supplying amounts of the atmosphere gasses to be supplied into the annealing furnace approach each other in the applications at both lines. To that extent, it is possible to suppress the atmosphere gas from being wastefully supplied. Particularly, since the operation which is necessary to obtain the effects can be only the opening and closing operation of the path on-off valve, it is possible to improve simplification and shortening of the line switching operation.

According to the dual-purpose facility of continuous hot-dip coating and continuous annealing according to (2), it is possible to make discharge amounts of the atmosphere gasses which are discharged from the outlet side of the annealing furnace to the outside of the furnace be the same extent as each other between when the facility is used as the continuous hot-dip coated material production line and when the facility is used as the continuous annealed material production line. As a result, it is possible to further reliably stabilize the furnace pressure balance in the annealing furnace when both lines are used. Thereby, operation conditions such as the ratio for each zone of the atmosphere gas supplied into the furnace or the total supplying amounts can be the same as each other at both lines. As a result, significant simplification or shortening of the line switching operation can be improved, adjustment errors of the operation conditions can be decreased, and therefore, stabilization of the operation can be improved. Particularly, after the discharge amount of the atmosphere gas is regulated by the flow rate regulating valve once, since the operation which is necessary for stabilizing the furnace pressure balance may be only the opening and closing operation of the path opening and closing unit, also from this point, simplification or shortening of the line switching operation can be improved.

According to the dual-purpose facility of continuous hot-dip coating and continuous annealing according to (3), it is possible to prevent a backflow of the outside air through the gas discharge path which is caused when change in the furnace pressure is generated during the operation of dual-purpose facility.

According to the dual-purpose facility of continuous hot-dip coating and continuous annealing according to (4), it is possible to prevent the backflow of the outside air through the gas discharge path while suppressing increases in the amount of the atmosphere gas to be supplied into the annealing furnace.

According to the dual-purpose facility of continuous hot-dip coating and continuous annealing according to (5), it is possible to suppress oxygen contained in the outside air or the like from penetrating into the annealing furnace through the gas discharge path due to diffusion.

According to the dual-purpose facility of continuous hot-dip coating and continuous annealing according to (6), it is possible to further effectively suppress oxygen contained in the outside air from penetrating into the annealing furnace through the gas discharge path due to diffusion.

According to the dual-purpose facility of continuous hot-dip coating and continuous annealing according to (7), it is possible to remove the metal fumes contained in the atmosphere gas which flows the gas discharge path while stabilizing the furnace pressure balance in the case in which when the facility is used as the continuous hot-dip coated material production line and when the facility is used as the continuous annealed material production line are compared to each other.

DETAILED DESCRIPTION OF THE INVENTION

Hereinafter, as embodiments for embodying the present invention, a dual-purpose facility of continuous hot-dip coating and continuous annealing, which is configured so as to change a continuous hot-dip coated material production line (hereinafter, also referred to as coated material production line) and a continuous annealed material production line (hereinafter, also referred to as annealed material production line), will be described in detail with reference to drawings.

First Embodiment

Figure 1:
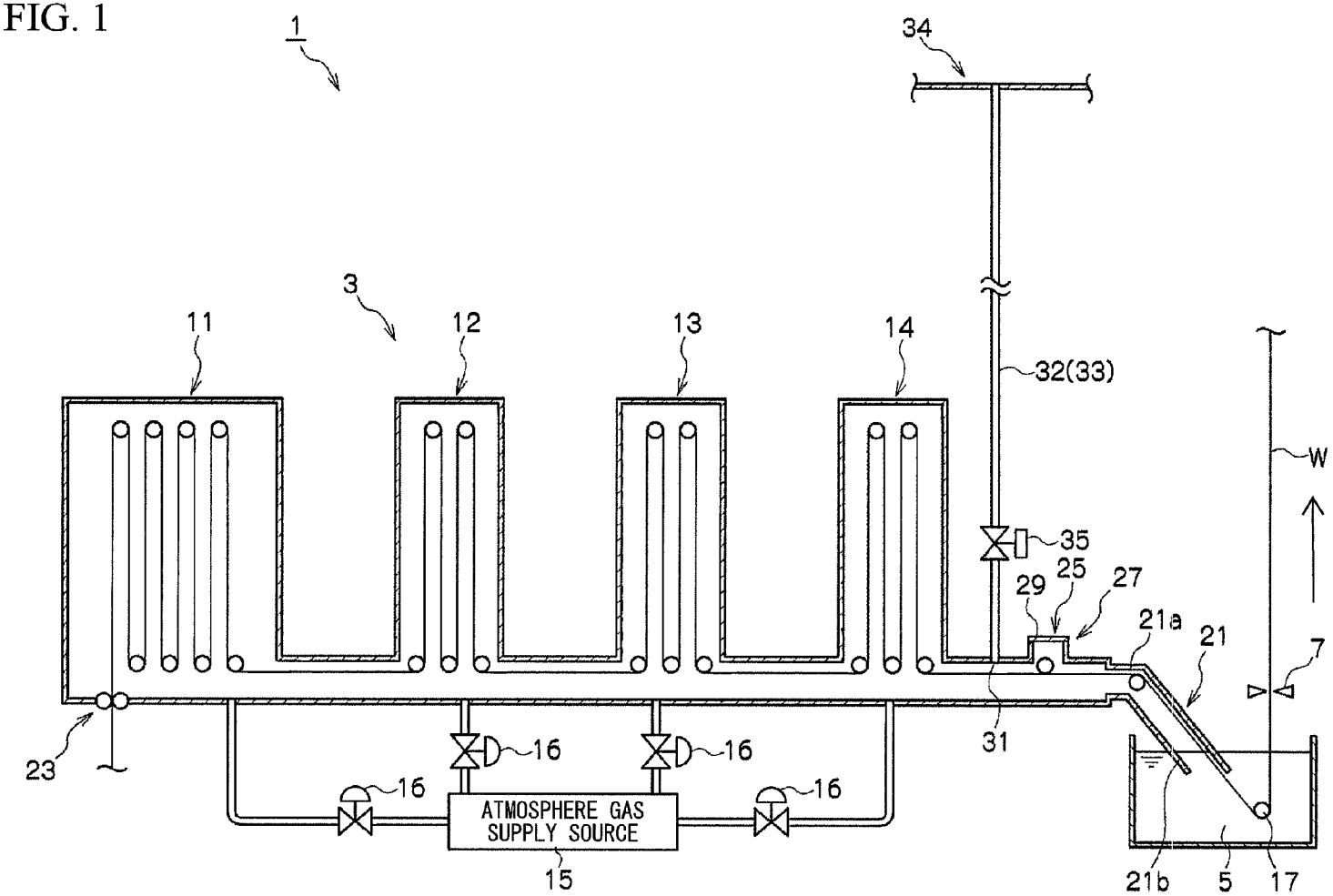
FIG. 1 is a view showing a first embodiment of a dual-purpose facility of continuous hot-dip coating and continuous annealing according to the present invention, and a longitudinal sectional view schematically showing when the facility is used as a continuous hot-dip coated material production line.
Figure 2:
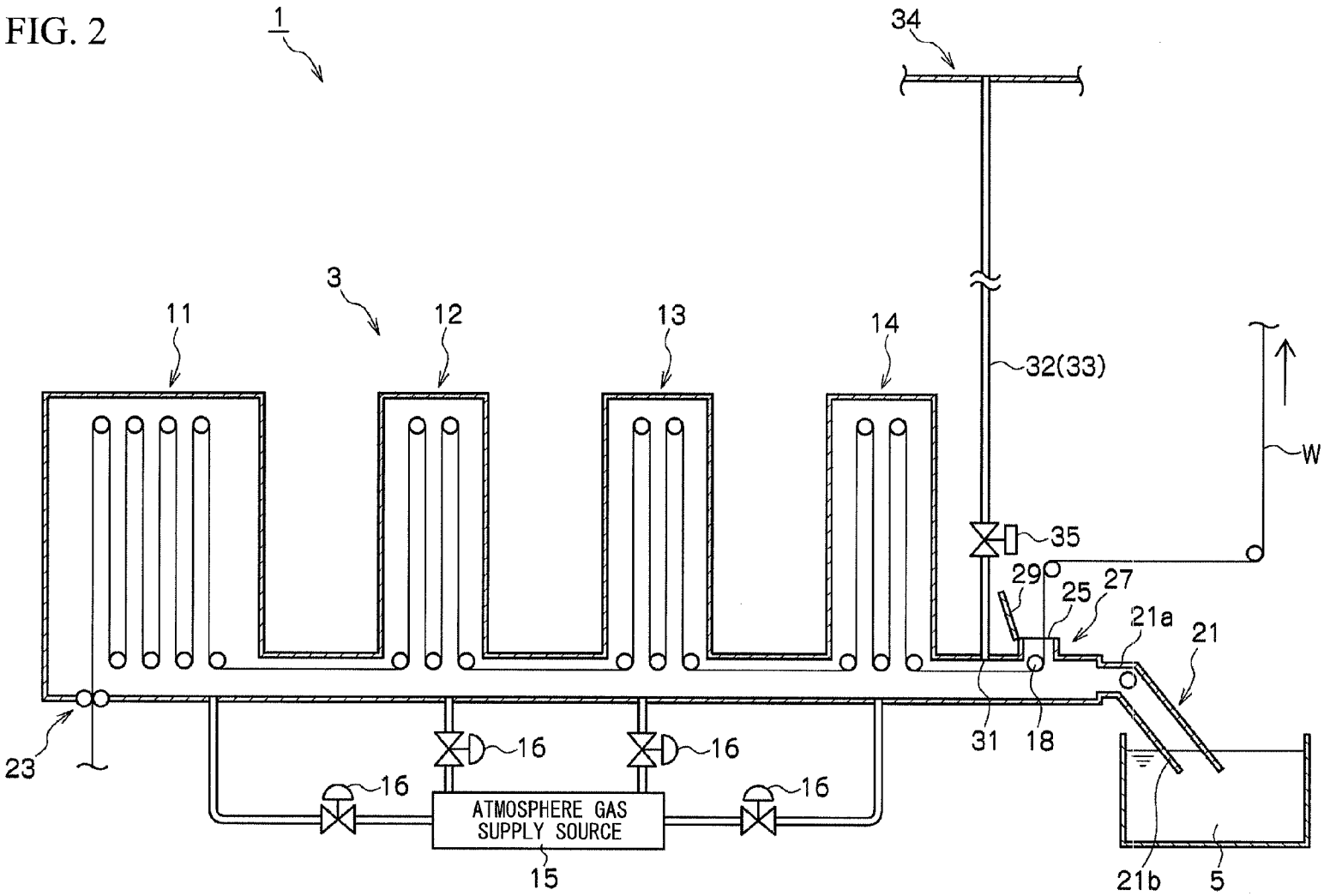
FIG. 2 is a longitudinal sectional view schematically showing when the dual-purpose facility is used as a continuous annealed material production line.

First, a first embodiment of the dual-purpose facility of continuous hot-dip coating and continuous annealing of the present invention (hereinafter, simply referred to as a "dual-purpose facility 1") will be described. FIGS. 1 and 2 are longitudinal sectional views showing a schematic configuration of the dual-purpose facility 1 according to the present embodiment, FIG. 1 shows a configuration when the facility is used as the coated material production line, and FIG. 2 shows a configuration when the facility is used as the annealed material production line.

The dual-purpose facility 1 according to the present embodiment includes an annealing furnace 3 for annealing a steel strip W and a hot-dip coating bath 5 for performing coating such as galvanizing to the steel strip W.

The annealing furnace 3 includes a heating zone 11 which heats the steel strip W, a soaking zone 12 which holds the heated steel strip W in a predetermined temperature range, and a slow cooling zone 13 and a cooling zone 14 which cool the steel strip W. The steel strip W is fed from a steel strip carrying-in port 23 which is provided in an inlet side of the heating zone 11 into the annealing furnace 3. After the steel strip is annealed by performing heat treatment under a predetermined condition in each zone 11, 12, 13, and 14, the steel strip is transported up to an outlet side of the cooling zone 14. In the furnace of each zone 11, 12, 13, and 14 of the annealing furnace 3, atmosphere gas is supplied from an atmosphere gas supply source 15. Ratio of a flow rate of the atmosphere gas, which is supplied from the atmosphere gas supply source 15 to each zone 11, 12, 13, and 14 of the annealing furnace 3, is regulated by a flow rate regulating valve 16. For example, as the atmosphere gas, mixed atmosphere gas of $H_2$ less than 10% by volume and the remainder $N_2$ is used.

The annealing furnace 3 further includes a tubular snout 21 which is installed between the outlet side of the furnace and the hot-dip coating bath 5. The snout 21 is one for immersing the steel strip W from the inner portion of the annealing furnace 3 into the hot-dip coating bath 5 without exposing the steel strip to the outside air when the facility is used as the plate material production line. An upper end portion 21*a* of the snout 21 is connected to the outlet side of the annealing furnace 3, and in the present embodiment, a lower end portion 21*b* of the snout is immersed into the hot-dip coating bath 5.

A gas discharge port 31 is provided in a side wall of the outlet side of the annealing furnace 3. One end (lower end) of a gas discharge pipe 32 is connected to the gas discharge port 31, and the other end (upper end) of the gas discharge pipe 32 communicates with the air outside the furnace. Thereby, a gas discharge path 33, which discharges the atmosphere gas in the annealing furnace 3 from the gas discharge port 31 to the outside of the furnace, is formed in the gas discharge pipe 32. Moreover, in the present embodiment, the other end of the gas discharge pipe 32 communicates with an outdoor space 34.

An on-off valve 35 which is a unit for opening and closing the gas discharge path 33 is installed in the middle of the gas discharge pipe 32. When the gas discharge path 33 is opened by the on-off valve 35, the atmosphere gas in the annealing furnace 3 is discharged to the outside of the furnace by a pressure difference between an internal pressure inside the furnace and an external pressure of air outside the furnace. The on-off valve 35 is controlled so as to be opened and closed by manual or electric operation according to the used line. However, the details will be described hereinafter.

The dual-purpose facility 1 of the present embodiment includes a bypass mechanism 27 for making the steel strip W bypass the hot-dip coating bath 5 and guiding the steel strip W into the air outside the furnace from the inner portion of the annealing furnace 3 when the facility is used as the annealed material production line. The bypass mechanism 27 includes a steel strip carrying-out port 25 which is provided in the outlet side of the annealing furnace 3 and an opening and closing damper 29 which opens and closes the steel strip carrying-out port 25.

Next, each operation when the dual-purpose facility 1 of the present embodiment is used as the coated material production line and when the facility is used as the annealed material production line will be explained.

As shown in FIG. 1, when the dual-purpose facility 1 is used as the coated material production line, the steel strip W is immersed into the hot-dip coating bath 5 and the hot-dip coating is performed. Specifically, after the steel strip W passing through the coated material production line is annealed in the annealing furnace 3, the steel strip W is immersed from the outlet side of the annealing furnace 3 into the hot-dip coating bath 5 through the snout 21. Thereafter, the direction of the steel strip W is converted upward by a guide roll 17 in the hot-dip coating bath 5 and is drawn from the hot-dip coating bath 5. After a coating amount is adjusted by a gas wiping device 7, continuously, the steel strip W is transported so as to be subjected to the subsequent process.

In addition, when the facility is used as the coated material production line, the steel strip carrying-out port 25 is closed by the opening and closing damper 29.

As shown in FIG. 2, when the dual-purpose facility 1 is used as the annealed material production line, the steel strip W bypasses the hot-dip coating bath 5 and is guided from the inner portion of the annealing furnace 3 into the air outside the furnace. Therefore, the hot-dip coating is set so as not to perform to the steel strip W. Specifically, after the steel strip W passing through the annealed material production line is annealed in the annealing furnace 3, the direction of the steel strip is vertically upward converted toward the steel strip carrying-out port 25 by the guide roll 18, and is guided into the air outside the furnace through the steel strip carrying-out port 25 which is previously opened by the opening and closing damper 29. Thereafter, similar to the steel strip W when the facility is used as the coated material production line, continuously, the steel strip W is transported toward the subsequent process.

In addition, the example shown in FIG. 2 shows that the steel strip W merges with the coated material production line after the steel strip W on the annealed material production line passes through the steel strip carrying-out port 25 and guided to the air outside the furnace. However, the merging position is not particularly limited if the steel strip bypasses the hot-dip coating bath 5.

Even when the facility is used as either of the coated material production line or the annealed material production line, as the subsequent process, for example, an alloying process, a temper rolling (skin pass rolling), electroplating, and the like is performed to the steel strip W as necessary, and thereafter, the steel strip W is coiled.

Figure 3A:
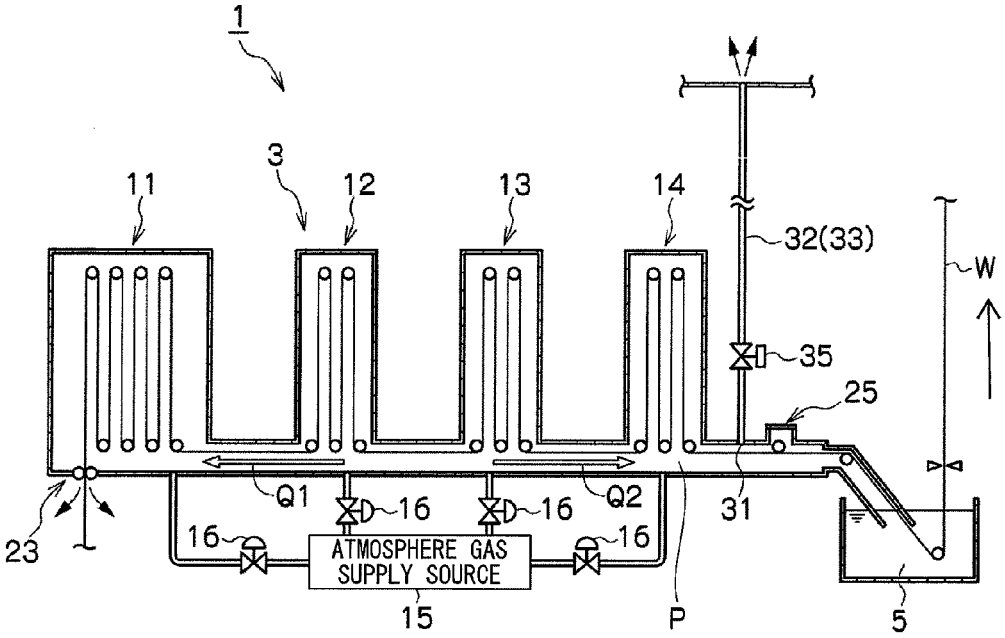
FIG. 3A is a longitudinal sectional view for explaining an operation when the dual-purpose facility is used as the continuous hot-dip coated material production line.

As shown in FIG. 3A, in the dual-purpose facility 1 according to the present embodiment, when the facility is used as the coated material production line, the on-off valve 35 is opened, and therefore, the gas discharge path 33 is opened. Therefore, when the facility is used as the coated material production line, not only the steel strip carrying-in port 23 of the inlet side of the annealing furnace 3 but also the gas discharge port 31 of the outlet side communicates with the air outside the furnace. As a result, the atmosphere gas in the annealing furnace 3 flows in two directions of a direction $Q_1$ toward the inlet side of the annealing furnace 3 and a direction $Q_2$ toward the outlet side. This means that the flow direction of the atmosphere gas can be adjusted so as to be the same even in either of the coated material production line and the annealed material production line.

Figure 3B:
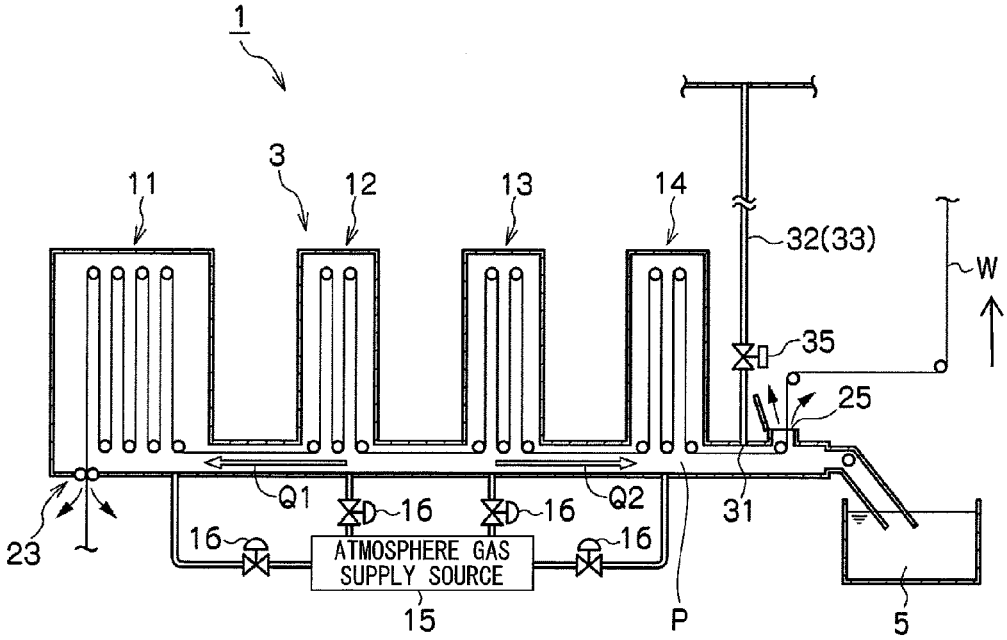
FIG. 3B is a longitudinal sectional view for explaining an operation when the dual-purpose facility is used as the continuous annealed material production line.

In addition, as shown in FIG. 3B, in the dual-purpose facility 1 according to the present embodiment, when the facility is used as the annealed material production line, the on-off valve 35 is closed, and therefore, the gas discharge path 33 is closed. The reason for this will be explained below. When the facility is used as the annealed material production line, since the steel strip carrying-out port 25 also is opened if the facility is the state where the gas discharge path 33 is opened, amount of the gas which is discharged from the outlet side of the annealing furnace 3 to the outside of the furnace is excessive. As a result, the amount of the gas discharged from the outlet side of the annealing furnace 3 when the facility is used as the coated material production line is significantly different from the amount of the gas discharged from the outlet side of the annealing furnace 3 when the facility is used as the annealed material production line. Thereby, since the furnace pressure balance is greatly changed in the case where the uses of both lines are compared, in order to make the amounts of the gasses which is discharged from the outlet side of the annealing furnace 3 when both lines are used approach each other and stabilize the furnace pressure balance, the gas discharge path 33 is closed when the facility is used as the annealed material production line.

In this way, since the opening and closing of the gas discharge path 33 is controlled by the on-off valve 35, the flow directions of the atmosphere gasses in the annealing furnace 3 can be adjusted so as to be the same when both lines are used, and it is possible to make the amounts of the gasses which are discharged from the outlet side of the annealing furnace 3 when both lines are used approach each other. Thereby, it is possible to stabilize the furnace pressure balance in the case where the uses of both lines are compared. In addition, since it is possible to make the amounts of the gasses which are discharged from the outlet side of the annealing furnace 3 approach each other in the case where the uses of both lines are compared, even when the pressure in the annealing furnace 3 is maintained so as to be in the same operation time between both lines, it is possible to make the total supplying amounts of the atmosphere gasses to be supplied into the annealing furnace 3 approach each other. To that extent, it is possible to suppress the atmosphere gas from being wastefully supplied. Particularly, since the operation which is necessary to obtain the effects may be only the opening and closing operation of the on-off valve 35, from this point, it is possible to improve simplification and shortening of the line switching operation.

Figure 4A:
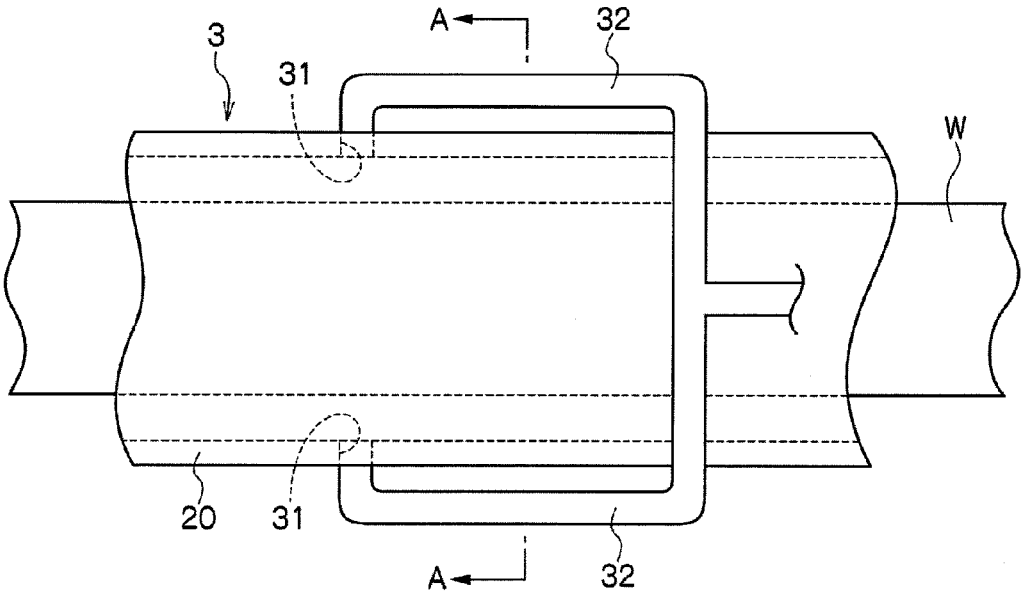
FIG. 4A is a plan view showing configurations of a gas discharge port and a gas discharge pipe which are provided in an outlet side of an annealing furnace of the dual-purpose facility.
Figure 4B:
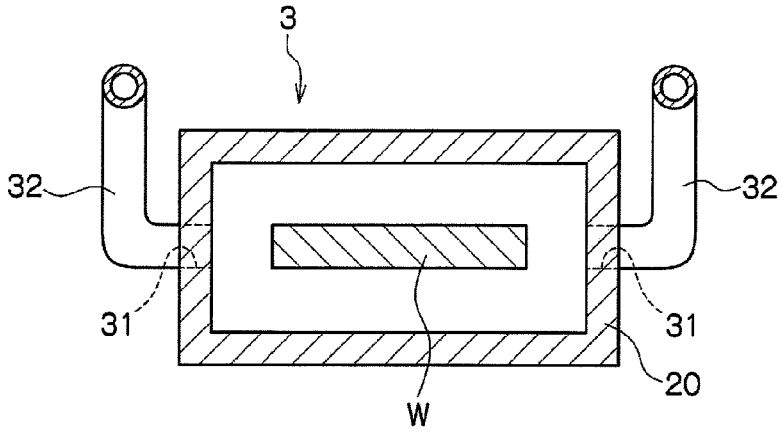
FIG. 4B is a view showing the gas discharge port and the gas discharge pipe, and a cross-sectional view taken along a line A-A of FIG. 4A.

FIG. 4A is a plan view showing configurations of the gas discharge port 31 and the gas discharge pipe 32 which are provided in the outlet side of the annealing furnace 3, and FIG. 4B is a cross-sectional view taken along a line A-A of FIG. 4A. According to reasons explained below, it is preferable that the gas discharge port 31 be provided in a furnace wall 20 of both sides in the width direction of the steel strip W. The atmosphere gas in the annealing furnace 3 when the facility is used as the coated material production line includes a large amount of metal fumes which are generated from the hot-dip coating bath 5. Thereby, if the gas discharge port 31 is provided in positions which are close to the front and rear surfaces of the steel strip W such as the upper portion of the steel strip W, the metal fumes is thickened and solidified in the vicinity of the gas discharge port 31 which becomes relatively easily low temperature due to the fact that the gas discharge port 31 is connected to the gas discharge pipe 32. As a result, after the generated solid-phase metal is deposited on the furnace wall around the discharge port, the solid-phase metal is dropped and attached on the steel strip W, and therefore, there is a concern that decrease in quality of the steel strip W may be generated. In order to avoid the disadvantage as possible, it is preferable that the gas discharge port 31 be provided in the furnace wall 20 facing both-side edges in the width direction of the steel strip W.

In order to make the discharge positions of the atmosphere gasses in the annealing furnace 3 when both lines are used approach each other and stabilize the furnace pressure balance in the case in which the uses of both lines are compared during a operation time, it is preferable that the gas discharge port 31 be provided in the vicinity of the steel strip carrying-out port 25. Moreover, the gas discharge port 31 may be provided in the snout 21. In addition, the case where the gas discharge path 33 is formed in the gas discharge pipe 32 is described in the above-described embodiment. However, for example, the gas discharge path 33 may be provided in holes which are formed in a furnace shell of the annealing furnace 3 and may be used.

The number of the gas discharge ports 31 or the gas discharge paths 33 is not particularly limited. However, as shown in FIGS. 4A and 4B, when a plurality (a pair) of gas discharge ports 31 are provided on the furnace wall 20 of both sides in the width direction of the steel strip W, it is preferable that each gas discharge pipe 32 connected to the plurality of gas discharge ports 31 be merged at a center position of a gap between each gas discharge port 31 and the pipe shape until being merged be configured so as to be symmetrical along the width direction of the steel strip W. Thereby, when the plurality of gas discharge pipes 32 are compared, the following advantages are obtained: it is possible to avoid occurrence in a piping pressure loss difference among the gas discharge pipes and it is possible to equally discharge the atmosphere gasses from the gas discharge ports 31 which are provided on both sides in the width direction of the steel strip W.

Second Embodiment

Next, a second embodiment of the dual-purpose facility of continuous hot-dip coating and continuous annealing according to the present invention will be described. Moreover, the components which are the same as those described in the first embodiment are denoted by the same reference symbols, and the descriptions are omitted below.

Figure 5:
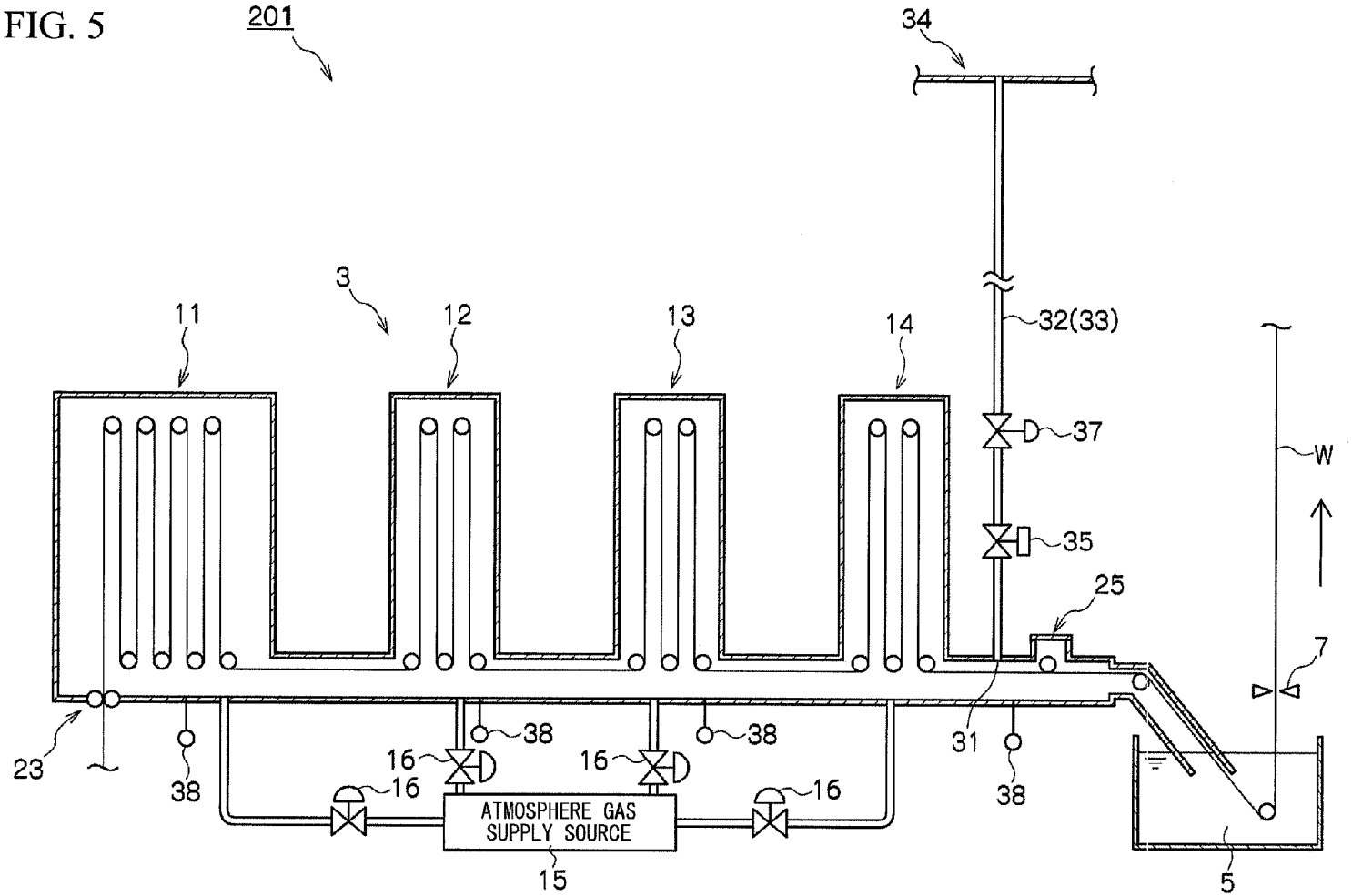
FIG. 5 is a longitudinal sectional view showing a second embodiment of the dual-purpose facility of the present invention.

FIG. 5 is a longitudinal sectional view showing a schematic configuration of a dual-purpose facility 201 of continuous hot-dip coating and continuous annealing according to the present embodiment.

In addition to the components of the dual-purpose facility 1 described in the first embodiment, the dual-purpose facility 201 according to the present embodiment further includes a flow rate regulating valve 37 which is disposed in the gas discharge path 33 and is a flow rate regulating unit for regulating the flow rate of the gas which flows in the gas discharge path 33, and a plurality of pressure gauges 38 which are units for measuring the pressure in the annealing furnace 3. The plurality of pressure gauges 38 are provided in a position in the vicinity of the steel strip carrying-out port 25 and the gas discharge port 31 and in each of positions of each zone 11, 12, and 13 in the annealing furnace 3.

The flow rate regulating valve 37 regulates the discharge amount of the atmosphere gas, which is discharged from the inner portion of the annealing furnace 3 to the outside of the furnace through the gas discharge path 33, by the degree of opening of the valve. Here, the discharge amount of the atmosphere gas when the facility is used as the coated material production line is regulated by the flow rate regulating valve 37 based on the idea as follows.

As described above, in the outlet side of the annealing furnace 3, the atmosphere gas is discharged from the gas discharge pass 33 to the outside of the furnace when the facility is used as the coated material production line, and the atmosphere gas is discharged from the steel strip carrying-out port 25 to the outside of the furnace when the facility is used as the annealed material production line. The discharge amounts of the atmosphere gasses, which are discharged to the outside of the furnace in the outlet side of the annealing furnace 3, when the facility is used as coated material production line and when facility is used as the annealed material production line are made to approach to each other by the opening and closing control of the flow rate regulating valve 37 as described above. However, some differences may be generated. Thereby, in the present embodiment, the discharge amounts of the atmosphere gasses are regulated so as to be the same extent as each other when the discharge amounts are compared at both lines.

Specifically, first, a furnace pressure P1 in the annealing furnace 3 when the facility is used as the annealed material production line is measured by the pressure gauge 38. Subsequently, when the facility is used as the coated material production line, the discharge amount of the atmosphere gas which is discharged from the inner portion of the annealing furnace 3 to the outside of the furnace through the gas discharge path 33 is regulated by the flow rate regulating valve 37 so that the pressure P2 in the annealing furnace 3 measured by the pressure gauge 38 is the same extent as the furnace pressure P1 based on the furnace pressure P1 which is measured in advance.

Thereby, the discharge amounts of the atmosphere gasses which are discharged to the outside of the furnace in the outlet side of the annealing furnace 3 can be the same extent as each other when the facility is used as the coated material production line and when the facility is used as the annealed material production line. As a result, it is possible to further reliably stabilize the furnace pressure balance in the annealing furnace 3 when both lines are used. Thereby, operation conditions such as the ratio for each zone 11, 12, 13, and 14 of the atmosphere gas supplied into the inner portion of the furnace or the total supplying amounts can be the same as each other at both lines. As a result, significant simplification or shortening of the line switching operation can be improved, adjustment errors of the operation conditions can be decreased, and therefore, stabilization of the operation can be improved. Particularly, after the discharge amount of the atmosphere gas is regulated by the flow rate regulating valve 37 once, since the operation which is necessary for stabilizing the furnace pressure balance may be only the opening and closing operation of the on-off valve 35, also from this point, simplification or shortening of the line switching operation can be improved.

In addition, when the regulation of the discharge amount of the atmosphere gas is performed as described above, furnace pressure information regarding the furnace pressures P1 and P2 which are measured and obtained by the pressure gauge 38 is sent to a process computer (not shown), and the process computer may regulate the degree of opening of the flow rate control valve 37 based on the sent furnace pressure information.

The pressure gauge 38 may be provided at least one of the positions in which the furnace pressure in the vicinity of the steel strip carrying-out port 25 and the gas discharge port 31 can be measured. This is because the degree of the pressure change when both lines are used is significantly great in the vicinity of the steel strip carrying-out port 25 and the gas discharge port 31, and the furnace pressure balances of the entire annealing furnace 3 in both lines can be the same extent as each other if the furnace pressures in at least the measured point in the both lines are the same as each other.

Third Embodiment

A third embodiment of the dual-purpose facility of continuous hot-dip coating and continuous annealing according to the present invention will be described. In addition, the components which are the same as those described in the first embodiment are denoted by the same reference symbols, and the descriptions are omitted below.

Figure 6:
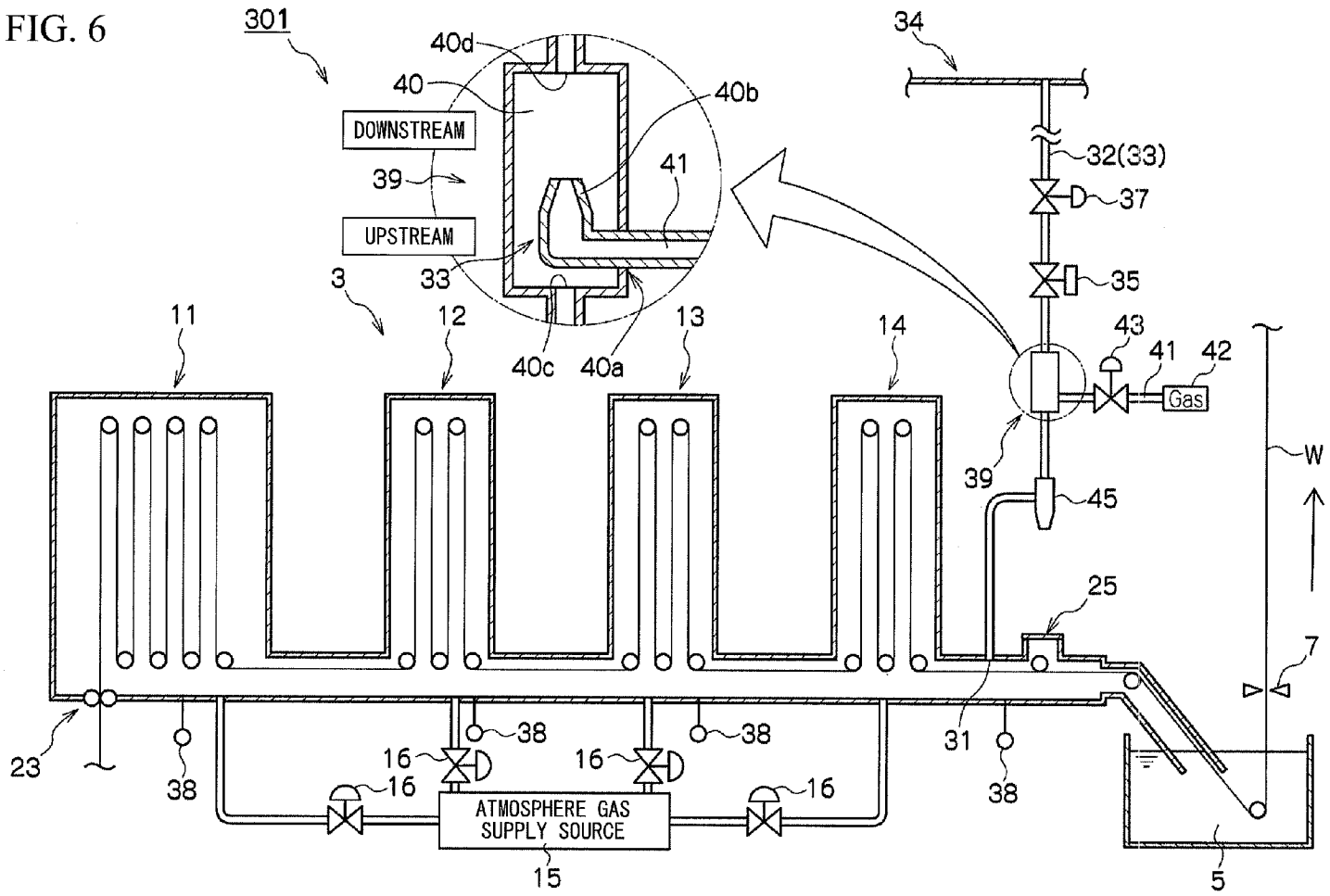
FIG. 6 is a longitudinal sectional view showing a third embodiment of the dual-purpose facility of the present invention.

FIG. 6 is a longitudinal sectional view showing a schematic configuration of a dual-purpose facility 301 of continuous hot-dip coating and continuous annealing according to the present embodiment.

In addition to the components of the dual-purpose facility 1 described in the first embodiment, the dual-purpose facility 301 according to the present embodiment further includes an ejector 39 which is disposed in the gas discharge path 33 and a cyclone 45 which is disposed in the gas discharge path 33.

The ejector 39 is a gas suction unit which suctions the atmosphere gas in the annealing furnace 3 and discharges this toward the outside of the furnace, and is positioned in the gas discharge path 33. In the ejector 39 referred here, gas is supplied into a nozzle **40*b* which is tapered from a gas supply port 40*a* of an ejector main body 40 toward the inner portion, and a negative pressure is generated in the downstream side in the ejector main body 40 by the flow of gas which is ejected from the tip of the nozzle 40*b*. Moreover, the ejector 39 suctions the atmosphere gas from a gas inlet 40*c* which is provided in the upstream side in the ejector main body 40 based on the generated negative pressure, and can discharge the suctioned atmosphere gas toward the outside of the furnace through a gas outlet 40*d* which is provided in the downstream side in the ejector main body 40**.

In addition, the gas supply port **40*a* of the ejector main body 40 is connected to the other end of a supply pipe 41 in which one end is connected to a gas supply source 42 for the ejector, and non-oxidizing gas such as $N_2$ is supplied from the gas supply source 42 for the ejector. In addition, a flow rate regulating valve 43 is disposed in the middle of the supply pipe 41, and the suction force of the ejector 39 can be controlled by regulating the degree of opening of the flow rate regulating valve 43**.

The ejector 39 is disposed according to the following reasons. The atmosphere gas in the annealing furnace 3 is discharged to the outside of the furnace through the gas discharge path 33 by a pressure difference between an internal pressure inside the furnace and an external pressure of the air outside the furnace. Thereby, when change or the like in the furnace pressure is generated during the operation of the dual-purpose facility 1, the outside air may flow back from the outside of the furnace into the annealing furnace 3 through the gas discharge path 33. If the outside air flows back, concentration of the outside air increases in the vicinity of the gas discharge port 31 of the annealing furnace 3, and there is a concern that quality of the steel strip W may be adversely affected.

Thereby, in the present embodiment, in order to prevent the backflow of the outside air, the ejector 39 which suctions the atmosphere gas in the annealing furnace 3 is disposed. Moreover, as a unit which suctions the atmosphere gas alternative to the ejector 39, there is a blower, fan, or the like. However, when strong suction force of the blower or the like is used, a large amount of atmosphere gas in the annealing furnace 3 is discharged, the amount of the atmosphere gas to be supplied into the annealing furnace 3 increases significantly, and there is a concern that the costs may increase. Therefore, it is preferable that the ejector 39 be used. Moreover, when the ejector 39 is used, since the suction force can be easily regulated by operating the flow rate regulating valve 43, also from this point, adoption of the ejector 39 is preferable.

In addition, the gas which is to be supplied into the ejector 39 for generating the negative pressure in the ejector 39 may be oxidized gas which contains oxygen such as air. However, it is preferable that the gas be non-oxidizing gas according to the following reasons. As described above, since the suction force of the ejector 39, which is used as the unit for suctioning the atmosphere gas in the annealing furnace 3, is not very strong, flow velocity of the gas in the gas discharge path 33 is also not fast. Thereby, oxygen contained in the air outside the annealing furnace 3 may penetrate into the annealing furnace 3 through the gas discharge path 33 due to diffusion thereof. Moreover, when the gas which is supplied into the ejector 39 is oxidized gas, similarly, the oxygen contained in the oxidized gas may penetrate into the annealing furnace 3. In order to prevent this, it is considered that the gas to be supplied into the ejector 39 is the non-oxidizing gas. In this case, due to the fact the downstream side in the ejector main body 40 is filled with the non-oxidizing gas and oxygen concentration in the gas discharge path 33 is decreased, penetration of the oxygen into the annealing furnace 3 due to diffusion can be suppressed, and deterioration in the quality of the steel strip W can be suppressed.

In addition, when the non-oxidizing gas is supplied into the ejector 39, as shown in FIG. 6, it is preferable that the ejector 39 be disposed to the inner portion side of the furnace rather than the flow rate regulating valve 37 in the gas discharge path 33. This is because the non-oxidizing gas supplied from the ejector 39 is easily filled in the gas discharge path 33 in response to the resistance of the flow rate regulating valve 37 and the penetration of the oxygen into the annealing furnace 3 due to diffusion can be further effectively suppressed if the ejector 39 is disposed to the inner portion side of the furnace rather than the flow rate regulating valve 37. This is particularly advantageous when the supply amount of the non-oxidizing gas which is supplied from the ejector 39 is small.

Moreover, it is needless to say that the gas suction unit such as the ejector 39 may be disposed to the outside of the furnace rather than the flow rate regulating valve 37 in the gas discharge path 33. In addition, when the non-deoxidizing gas is supplied into the ejector 39, the atmosphere gas in the annealing furnace 3 is used, the pressure of the atmosphere gas is increased by a blower or the like, and the atmosphere gas may be supplied into the ejector 39.

The cyclone 45 functions as a dust collector which separates solid particles, liquid droplets, or the like contained in the fluid through the difference in specific gravity using centrifugal force which is generated when the fluid is a rotational flow. The cyclone 45 is disposed so as to remove the metal fumes contained in the atmosphere gas which flows the gas discharge path 33, and therefore, scattering of the metal fumes into the outside air can be prevented, it is possible to improve environmental protection. Moreover, it is considered that a filter or the like is used as the dust collector. However, if the filter or the like is used, pressure loss or clogging is generated, and it is difficult to discharge the atmosphere gas in the annealing furnace 3 to the outside of the furnace, and as a result, the furnace pressure balance when both lines are used may be unstable. Therefore, it is preferable that the cyclone 45 be used as the dust collector.

It is preferable that the cyclone 45 be disposed in a position close to the inner portion side of the furnace with respect to the ejector 39 or the like which is a unit for suctioning the atmosphere gas in the gas discharge path 33. Thereby, since the metal fumes, which are generated from the hot-dip coating bath 5 when the facility is used as the coated material production line and flows into the gas discharge path 33, can be early removed, it is possible to advantageously prevent the gas discharge path 33 from being occluded due to the solid-phase metal generated by solidification of the metal fumes.

Moreover, for example, as an alternative to the flow rate regulating valve 37 described in the second embodiment, the ejector 39 described in the present embodiment may be used.

Fourth Embodiment

A fourth embodiment of the dual-purpose facility of continuous hot-dip coating and continuous annealing according to the present invention will be described. In addition, the components which are the same as those described in the first embodiment are denoted by the same reference symbols, and the descriptions are omitted below.

Figure 7:
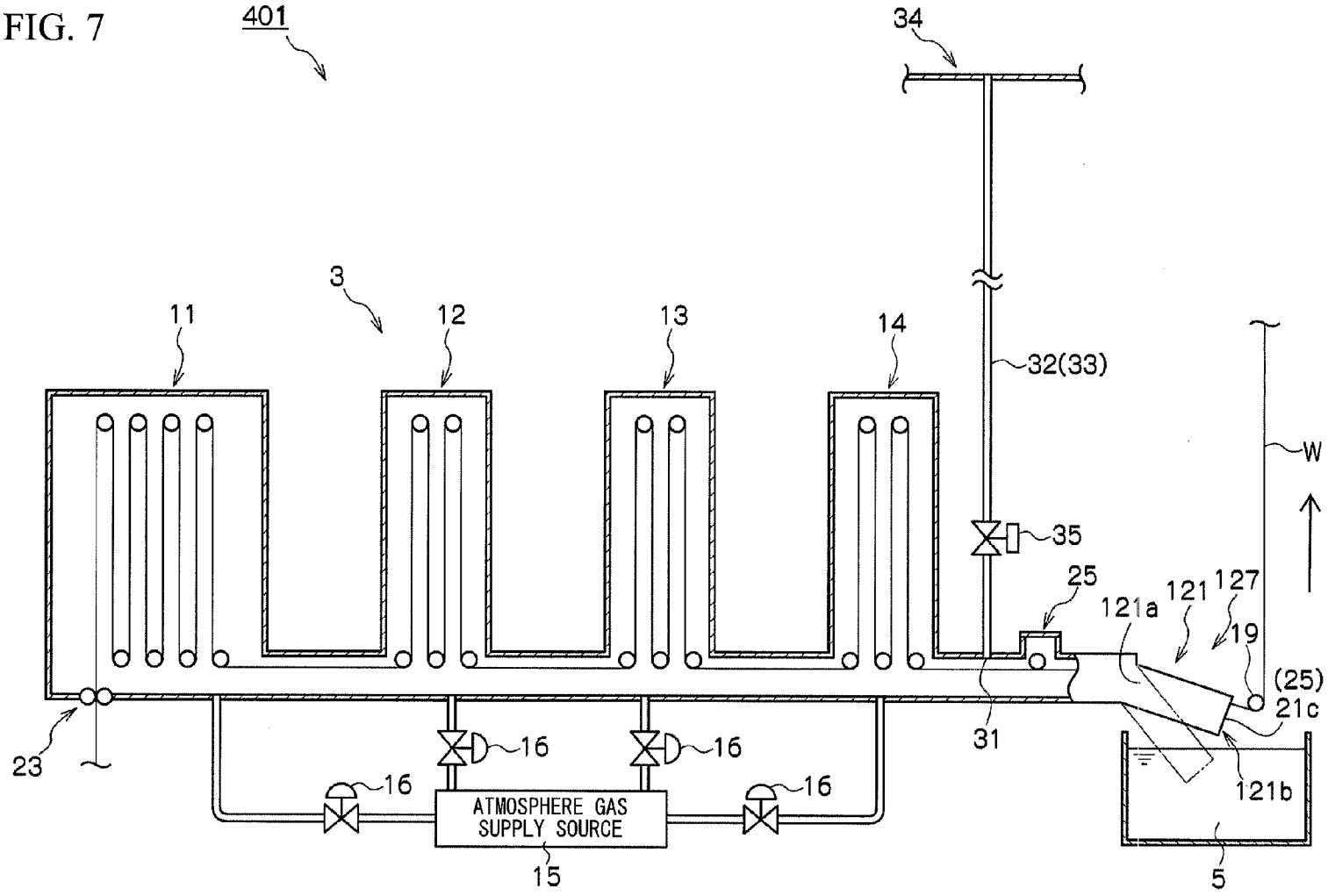
FIG. 7 is a longitudinal sectional view showing a fourth embodiment of the dual-purpose facility of the present invention.

FIG. 7 is a side view showing a schematic configuration of a dual-purpose facility 401 according to the present embodiment.

In the present embodiment, a bypass mechanism 127 is different from the bypass mechanism 27 described in the first embodiment. In the bypass mechanism 127 of the present embodiment, a fulcrum shaft (not shown) is mounted on the upper end portion 121*a* thereof, and a snout 121 which can be rotated up and down according to rotation of the fulcrum shaft by driving a cylinder (not shown) or the like is provided.

When the facility is used as the annealed material production line, the snout 121 is rotated upward around the fulcrum shaft, and therefore, a lower end opening 121*b* of the snout 121 is lifted up above the surface of the hot-dip coating bath 5. Thereby, the lower end opening 121*b* of the snout 121 can be used as the steel strip carrying-out port 25 which guides the steel strip W from the inner portion of the annealing furnace 3 into the air outside the furnace. Therefore, if a guide roll 19 is previously disposed in the outlet side of the hot-dip coating bath 5, after the steel strip W annealed in the annealing furnace 3 passes from the outlet side of the annealing furnace 3 through the snout 121 and the lower end opening 121*b* of the snout 121 in order, the direction of the steel strip W is converted upward by the guide roll 19. Thus, according to the procedure similar to that described in the first embodiment, the steel strip W can be transported.

In this way, the configuration of the bypass mechanism 127 is not particularly limited if the steel strip W bypasses the hot-dip coating bath 5 and can be guided from the inner portion of the annealing furnace 3 into the air outside the furnace when the facility is used as the annealed material production line.

As described above, each embodiment of the present invention is described in detail. However, each of the above-described embodiments shows only an example which embodies the present invention, and technical scope of the present invention should not be interpreted as limited only by the embodiments.

Example 1

Hereinafter, effects of the present invention will be further described according to examples. In the present examples, tests in which the steel strip was produced in both lines were performed using the dual-purpose facility in which the coated material production line and the annealed material production line are configured so as to be switched to each other as shown in FIGS. 3, 5, 6, and 8.

In tests, the steel strip of 1.0 mm×1500 mm in a sheet thickness×a plate width was used, and a line speed was set to 100 m/min. In addition, the tests were performed under test conditions shown in Table 1 below. Moreover, for example, all oxygen concentration variations in the furnace in Table 1 were measured in the position P of the cooling zone 14 in FIGS. 3A and 3B.

In Test No. 4, in addition to the conditions of Test No. 3, as shown in FIG. 5, the dual-purpose facility 201 including the flow rate regulating valve 37 disposed in the gas discharge path 33 and the pressure gauge 38 measuring the furnace pressure in the annealing furnace 3 was used. In Test No. 4, the furnace pressure P1 in each zone 11, 12, 13, and 14 in the annealing furnace 3 when the facility is used as the annealed material production line and the furnace pressure P2 in each zone 11, 12, 13, and 14 in the annealing furnace 3 when the facility was used as the coated material production line were measured by the pressure gauge 38. Moreover, the discharge amount of the atmosphere gas through the gas discharge path 33 was previously regulated by the flow rate regulating valve 37 so that the furnace pressure P2 when the facility was used as the coated material production line was the same as the furnace pressure P1 when facility used as the annealed material production line.

In Test No. 5, in addition to the conditions of Test No. 4, the dual-purpose facility 301 including the ejector 39 which was disposed in the gas discharge path 33, suctioned the atmosphere gas in the annealing furnace 3, and discharged the gas toward the outside of the furnace as shown in FIG. 6 was used.

TABLE 1

| | | Test conditions | | | | Test results | | | | | | |
|---|---|---|---|---|---|---|---|---|---|---|---|---|
| | | | | | | Furnace pressure (Pa) (annealed material production line/ coated material production line) | | | | Total supplying amount of atmosphere gas into annealing furnace ($m^3$/h) *1 | | Variation of oxygen concentration in furnace (ppm) |
| | Test No. | Gas discharge pipe | On-off valve | Flow rate regulating valve | Ejector | Heating zone | Soaking zone | Slow cooling zone | Cooling zone | Annealed material production line | Coated material production line | |
| Comparative Example | 1 | x | x | x | x | 200/200 | 200/200 | 200/250 | 200/300 | 3500 (1400/500/500/1100) | 2500 (1000/360/360/780) | 0 |
| Comparative Example | 2 | ○ | x | x | x | 300/200 | 300/200 | 250/180 | 200/150 | 4000 (1600/570/570/1260) | 3700 (1480/530/530/1160) | +20 |
| Inventive Example | 3 | ○ | ○ | x | x | 200/200 | 200/200 | 200/180 | 200/150 | 3500 (1400/500/500/1100) | 3700 (1480/530/530/1160) | +20 |
| Inventive Example | 4 | ○ | ○ | ○ | x | 200/200 | 200/200 | 200/200 | 200/200 | 3500 (1400/500/500/1100) | 3500 (1400/500/500/1100) | +10 |
| Inventive Example | 5 | ○ | ○ | ○ | ○ | 200/200 | 200/200 | 200/200 | 200/200 | 3500 (1400/500/500/1100) | 3500 (1400/500/500/1100) | 0 |

*1: Gas supplying amount per 1 hour at 1 atm and 0° C. ($m^3$)
Numbers in ( ) indicate supplying amount into heating zone, soaking zone, slow cooling zone, and cooling zone in order.

Figure 8A:
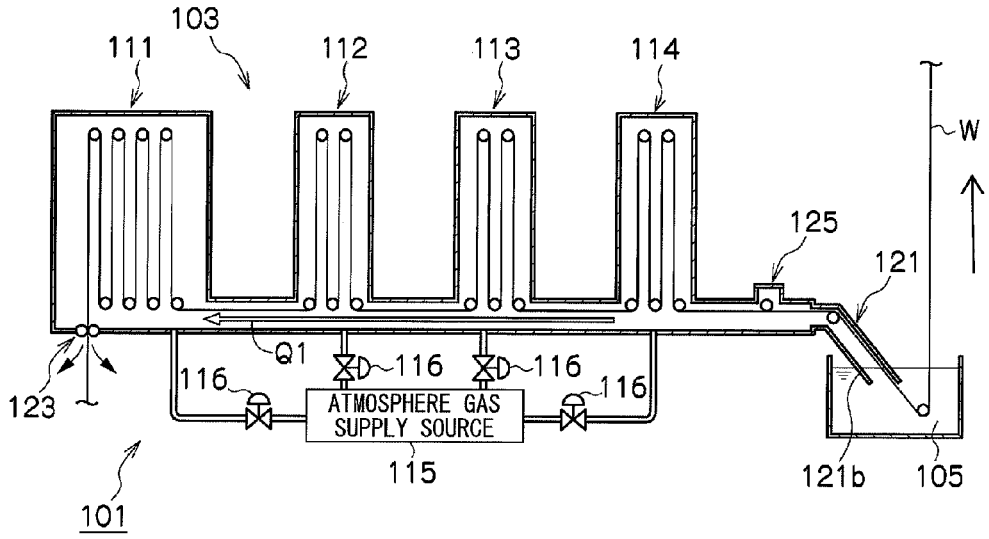
FIG. 8A is a view showing an example of a dual-purpose facility in a conventional technique, and a longitudinal sectional view schematically showing when the facility is used as the continuous hot-dip coated material production line.
Figure 8B:
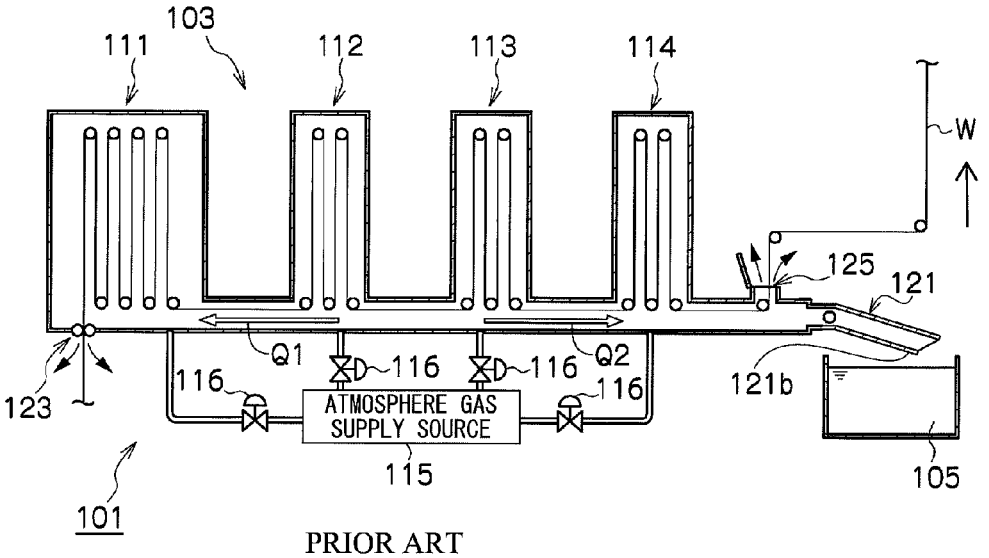
PRIOR ART FIG. 8B
FIG. 8B is a view showing the dual-purpose facility, and a longitudinal sectional view schematically showing when the facility is used as the continuous annealed material production line.

Test No. 1 and Test No. 2 are outside the scope of the present invention. In Test No. 1, as shown in FIGS. 8A and 8B, the dual-purpose facility in which the gas discharge pipe 32 or the on-off valve 35 was not present was used. In Test No. 2, although not shown, the dual-purpose facility in which only the gas discharge pipe 32 was present and the on-off valve 35 was not present was used.

Test Nos. 3 to 5 are within the scope of the present invention. In Test No. 3, the dual-purpose facility 1 in which the gas discharge pipe 32 and the on-off valve 35 shown in FIGS. 3A and 3B were present was used. In Test No. 3, the on-off valve 35 was configured so as to close the gas discharge path 33 in the gas discharge pipe 32 when the facility was used as the annealed material production line and so as to open the gas discharge path 33 when the facility was used as the coated material production line.

As the gas supplied for generating the negative pressure with respect to the ejector 39, $N_2$ which was the non-oxidizing gas was used.

In Table 1, with respect to the gas discharge path 33, the on-off valve 35, the flow rate regulating valve 37, and the ejector 39, the case where components similar to those of each of the above-described embodiments was used is denoted by o, and the case where components similar to those of each of the above-described embodiments was not used is denoted by x.

In Test No. 1, when the facility is used as the annealed material production line, the supplying amount of the atmosphere gas which was supplied to each zone 111, 112, 113, and 114 from the atmosphere gas supply source 115 was regulated by the flow rate regulating valve 116 so that all furnace pressures P1 of each zone 111, 112, 113, and 114 were 200 Pa. In addition, in Test No. 1, when the facility was switched from the annealed material production line to the coated material production line, only total supplying amount of the atmosphere gas from the atmosphere gas supply source 115 was regulated without operating the flow rate regulating valve 116 so that the furnace pressure P2 of the heating zone 111 was 200 Pa.

In Test Nos. 2 to 5, when the facility was used as the annealed material production line, the flow rate regulating valve 16 was regulated so that the conditions in the ratio of the supplying amount of the atmosphere gas which was supplied to each zone 11, 12, 13, and 14 were the same as the conditions of Test No. 1, and only total supplying amount of the atmosphere gas from the atmosphere gas supply source 15 was regulated so that the minimum furnace pressure of each zone 11, 12, 13, and 14 was 200 Pa. In addition, in Test Nos. 2 to 5, when the facility was switched from the annealed material production line to the coated material production line, only the total supplying amount of the atmosphere gas from the atmosphere gas supply source 15 was regulated without operating the flow rate regulating valve 16 so that the furnace pressure P2 of the heating zone 11 was 200 Pa.

Each example was estimated by the furnace pressures in each of the zones 11, 12, 13, and 14 of the annealing furnace 3 which were measured when both lines were used, and the total supplying amount of the atmosphere gas which was supplied into each zone 11, 12, 13, and 14 in the annealing furnace 3 from the atmosphere gas supply source 15 when both lines were used. In addition, the oxygen concentration in the annealing furnace 3 at the time of normal when the coated material production line was used was set to 10 ppm as the reference value, the furnace pressure was artificially changed by changing the rotational frequency of the blower of the cooling zone 14, and therefore, each example was estimated by measuring variation of the oxygen concentration which was changed from the reference value when the furnace pressure was changed.

As a result, in Test No. 1, in order to make the furnace pressure of the heating zone be 200 Pa when the facility was switched from the annealed material production line to the coated material production line, it was necessary to further change the total supplying amount of the atmosphere gas by 1000 $m^3$/h, and it was confirmed that the furnace pressure of the slow cooling zone after the facility was switched to the coated material production line was further changed by 50 Pa and the furnace pressure of the cooling zone was further changed by 100 Pa.

In addition, as understood by comparing Test No. 1 with Test No. 2, in the case where only the gas discharge pipe 32 was provided, only tendencies in which the furnace pressure balance was changed became the opposite when both lines were used, and it was confirmed that variation in the furnace pressure after the facility was switched to the coated material production line was 100 Pa at most.

In contrast, in Test No. 3, as understood by comparing with Test No. 1, variation in the furnace pressure of the slow cooling zone after the facility was switched to the coated material production line was about 20 Pa, variation in the furnace pressure of the cooling zone was about 50 Pa, and therefore, it was confirmed that variation in the furnace pressure was greatly decreased. Thereby, according to application of the present invention, variation in the furnace pressure at each zone when lines are switched to each other can be decreased, and it was confirmed that stabilization in the furnace pressure balance could be achieved in the case where uses of both lines were compared.

Moreover, in Test No. 3, as understood by comparing with Test No. 1, it was confirmed that the variation in the total supplying amounts of the atmosphere gas necessary for making the furnace pressure of the heating zone 11 be 200 Pa when the facility was switched from the annealed material production line to the coated material production line was decreased from 1000 $m^3$/h to 200 $m^3$/h. Thereby, according to the application of the present invention, it was confirmed that wasteful supply of the atmosphere gas was suppressed.

In addition, in Test No. 4, as understood by comparing with Test No. 1 and Test No. 3, it was confirmed that a change in the total supplying amounts of the atmosphere gas was not needed for making the furnace pressure of the heating zone 11 be 200 Pa when the facility was switched from the annealed material production line to the coated material production line, and the furnace pressures at each zone 11, 12, 13, and 14 before and after the switching of the line were the same as each other. Thereby, according to the application of the flow rate regulating valve 37, it is possible to further reliably stabilize the furnace pressure balance when uses of both lines are compared, and it was confirmed that operation conditions such as ratios for each zone 11, 12, 13, and 14 or the total supplying amounts, and the like of the atmosphere gas supplied into the furnace could be the same as each other in both lines.

Moreover, as understood by comparing Test No. 5 with Test No. 3 and Test No. 4, according to the application of the ejector 39, it was confirmed that increase in the oxygen concentration in the furnace even at the time of the change in the furnace pressure could be prevented while the furnace pressure balance was stabilized in the case where the uses of both lines are compared.

INDUSTRIAL APPLICABILITY

The present invention can provide the dual-purpose facility of continuous hot-dip coating and continuous annealing capable of advantageously solving problems due to change in the flow direction of the atmosphere gas in the annealing furnace when the facility is used so as to be switched between the continuous hot-dip coated material production line and the continuous annealed material production line.

REFERENCE SYMBOL LIST

1, 201, 301, 401: dual-purpose facility of continuous hot-dip coating and continuous annealing
3: annealing furnace
5: hot-dip coating bath
21: snout
23: steel strip carrying-in port
25: steel strip carrying-out port
31: gas discharge port
32: gas discharge pipe
33: gas discharge path
34: outdoor space
35: on-off valve
37: flow rate regulating valve
38: pressure gauge
39: ejector
45: cyclone
W: steel strip

What is claimed is:

1. A dual-purpose facility of continuous hot-dip coating and continuous annealing which is configured so as to be switched between a continuous hot-dip coated material production line in which a steel strip annealed in an annealing furnace including a cooling zone is immersed into a hot-dip coating bath and a continuous annealed material production line in which the steel strip bypasses the hot-dip coating bath and is guided out of the annealing furnace into an air outside the furnace, the dual-purpose facility comprising:

a gas discharge path that discharges atmosphere gas in the annealing furnace from a gas discharge port provided in an outlet side of the annealing furnace into the air outside the annealing furnace, the gas discharge port positioned downstream from the cooling zone; and a path opening and closing unit for opening and closing the gas discharge path, wherein the path opening and closing unit opens the gas discharge path when the dual-purpose facility is used as the continuous hot-dip coated material production line and closes the gas discharge path when the dual-purpose facility is used as the continuous annealed material production line.

2. The dual-purpose facility of continuous hot-dip coating and continuous annealing according to claim 1, further comprising a flow rate regulating unit that is disposed in the gas discharge path; and a furnace pressure measuring unit for measuring a furnace pressure in the annealing furnace, wherein a discharge amount of the atmosphere gas, which is discharged out of the annealing furnace through the gas discharge path when the dual-purpose facility is used as the continuous hot-dip coated material production line, is regulated by the flow rate regulating unit based on the furnace pressure which is measured by the furnace pressure measuring unit when the dual-purpose facility is used as the continuous annealed material production line.

3. The dual-purpose facility of continuous hot-dip coating and continuous annealing according to claim 1, further comprising a gas suction unit that is disposed in the gas discharge path, for suctioning the atmosphere gas in the annealing furnace, and for discharging the gas out of the annealing furnace.

4. The dual-purpose facility of continuous hot-dip coating and continuous annealing according to claim 3, wherein the gas suction unit is an ejector.

5. The dual-purpose facility of continuous hot-dip coating and continuous annealing according to claim 4, wherein the ejector is disposed to an upstream side of a flow rate regulating unit that is disposed in the gas discharge path.

6. The dual-purpose facility of continuous hot-dip coating and continuous annealing according to claim 2, further comprising a gas suction unit that is disposed in the gas discharge path, for suctioning the atmosphere gas in the annealing furnace, and for discharging the gas out of the annealing furnace.

7. The dual-purpose facility of continuous hot-dip coating and continuous annealing according to claim 6, wherein the gas suction unit is an ejector.

8. The dual-purpose facility of continuous hot-dip coating and continuous annealing according to claim 7, wherein the ejector is disposed to an upstream side of a flow rate regulating unit that is disposed in the gas discharge path.

* * * * *